US005611517A

United States Patent [19]

Saadi et al.

[11] Patent Number: 5,611,517

[45] Date of Patent: Mar. 18, 1997

[54] CONTROL UNIT FOR AUTOMATIC FAUCET

[75] Inventors: Robert E. Saadi; Brian N. Creager; Allen R. Becker, all of Erie, Pa.; Stephen R. Kovey, Glen Ellyn, Ill.

[73] Assignee: Zurn Industries, Inc., Erie, Pa.

[21] Appl. No.: 425,841

[22] Filed: Apr. 20, 1995

[51] Int. Cl.[6] ..... E03D 5/10

[52] U.S. Cl. ..... 251/129.04; 4/623

[58] Field of Search ..... 251/129.04, 30.03, 251/30.04, 30.05, 368; 4/304, 305, DIG. 3, 623

[56] References Cited

U.S. PATENT DOCUMENTS

| | | | |
|---|---|---|---|
| 3,639,920 | 2/1972 | Griffin et al. . | |
| 3,724,001 | 4/1973 | Ichimori et al. . | |
| 4,604,764 | 8/1986 | Enzo . | |
| 4,793,588 | 12/1988 | Laverty, Jr. | 251/30.03 |
| 4,941,219 | 7/1990 | Van Marcke . | |
| 5,060,323 | 10/1991 | Shaw . | |
| 5,224,509 | 7/1993 | Tanaka et al. | 251/129.04 X |
| 5,431,181 | 7/1995 | Saadi et al. | 251/129.04 X |
| 5,482,250 | 1/1996 | Kodaira | 251/129.04 |

OTHER PUBLICATIONS

Toto brochure entitled "Automatic Faucet", 2 pages.

Burkert Contromatic, Inc. catalog (4 pp.), 1992.

*Primary Examiner*—Kevin Lee

*Attorney, Agent, or Firm*—Webb Ziesenheim Bruening Logsdon Orkin & Hanson, P.C.

[57] ABSTRACT

A tamper-resistant control unit for an automatic faucet comprises a case having separate compartments therein for receiving a solenoid-activated valve and a circuit board and battery pack, respectively.

13 Claims, 3 Drawing Sheets

CONTROL UNIT FOR AUTOMATIC FAUCET

BACKGROUND OF THE INVENTION

Throughout public washroom facilities, as protection against the spread of disease and the waste of water, automatic faucets have been installed. These faucets are activated by placing a hand in the vicinity of the outlet of the faucet spout. Mounted in the faucet spout are sensors (for example, infrared transmitter and receiver units) that detect the presence of an object and activate an electronic circuit to open an automatic water valve controlling the flow to the spout.

It is desirable that the automatic faucet including the control unit be easily installed since they are installed in new buildings where labor costs may far exceed the cost of the hardware. The control unit should be reasonably tamper proof even though generally placed out of sight. The control unit must be easily serviced by the replacement of the batteries providing the electrical power for the operation of the control unit.

One approach to providing an easily installed automatic faucet is disclosed in U.S. Pat. No. 5,060,323.

It is an object, according to this invention, to provide an easily installed and easily serviced control unit for an automatic faucet.

SUMMARY OF THE INVENTION

Briefly, according to this invention, there is provided a tamper-resistant control unit for an automatic faucet. The automatic faucet includes a spout having a transmitter and receiver mounted therein for detecting the presence of objects near the faucet. A solenoid-activated valve assembly has inlet and outlet conduits extending therefrom. An electronic circuit is mounted on a circuit board for communicating electronically with the transmitter and receiver and for energizing the solenoid when an object is in the vicinity of the faucet. A battery pack supplies direct current to the electronic circuit, the transmitter and the solenoid. A case encloses the solenoid-activated valve, the circuit board and the battery pack. The case has separate compartments for receiving the solenoid-activated control valve on the one hand and the circuit board and battery pack on the other hand. The case is comprised of a box portion and a lid. The box portion has a dividing wall therein to separate a solenoid-activated valve compartment from a sealed electric compartment. In the solenoid-activated valve compartment, there is formed a cradle to receive the solenoid-activated valve with the inlet and outlet conduits thereof extending out of openings provided therefor in the case. A grommet is provided for passing control wires from the solenoid-activated valve compartment to the electric compartment while maintaining a seal therebetween. A seal is provided between the lid and the box portion of the case for sealing the electric compartment. The battery pack is arranged to slide into and out of the electric compartment without removal of the lid.

According to a preferred embodiment, the case is comprised of high-impact strength plastic, most preferably of acrylonitrile butadiene styrene/polycarbonate plastic. According to one preferred embodiment, the solenoid-activated valve is comprised of reinforced polyphenylene oxide polymers. Preferably, the control valve is a diaphragm-type valve with a solenoid-controlled pilot chamber. According to one embodiment, the inlet to the solenoid-activated valve is a one-half inch NPSM thread for connecting a standard ball riser.

According to a preferred embodiment, the case is provided with a space for a pull tab which is a nonconductive tape for interrupting the battery circuit such that the control assembly can be shipped with batteries in place and upon installation the pull tab can be withdrawn to activate the control circuit.

BRIEF DESCRIPTION OF THE DRAWINGS

Further features and other object and advantages of this invention will become clear from the following detailed description made with reference to the drawings in which.

DESCRIPTION OF THE PREFERRED EMBODIMENTS

Figure 1:
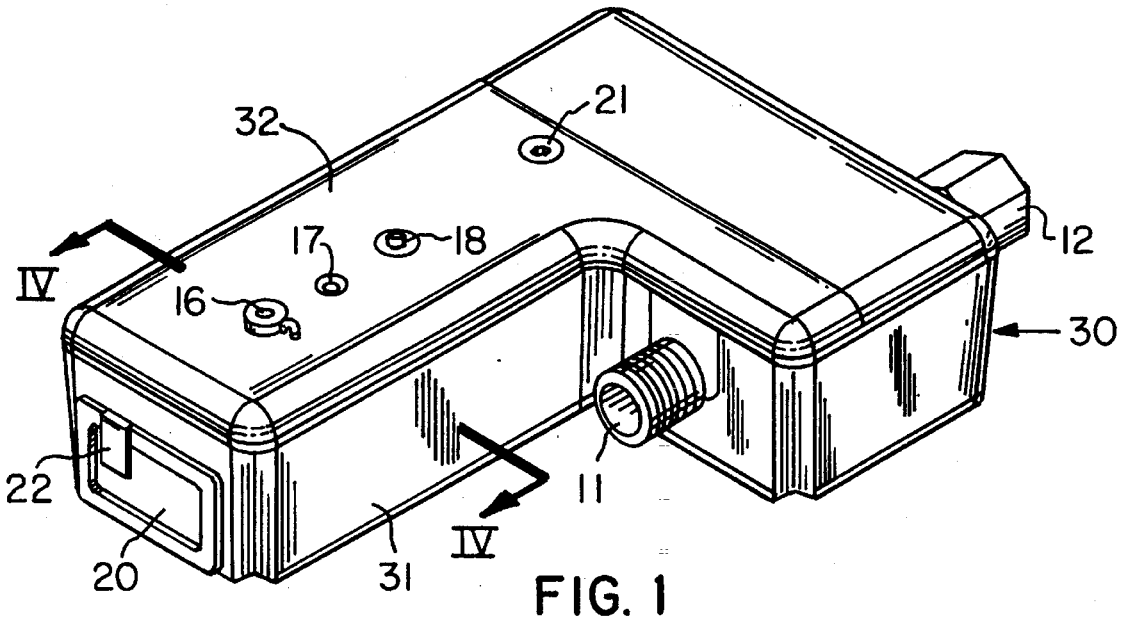
FIG. 1 is a perspective view of a control unit according to this invention.

Referring to FIG. 1, there is shown an assembled tamper-resistant control unit for an automatic faucet. The control unit comprises a case 30 that cradles the solenoid valve, the inlet conduit 11 and outlet conduit 12 of which extend out of the case. A mesh screen filter can be provided in the inlet conduit. The case is comprised of a unitary box portion 31 and a lid 32 which are secured together by a plurality of stainless steel screws. The inlet of the solenoid valve has one-half inch NPSM thread enabling connection to commonly available water conduits. The box portion and the lid are cast from tough plastic material such as ABS/PC (acrylonitrile butadiene styrene/polycarbonate) alloy plastic material. This material combines the high-impact strength of polycarbonate with the electric insulating properties and ductility of ABS. The screws (not shown) have tamper-proof heads, for example, hex bore heads. A battery pack 20 slides into the case 30 and is secured therein by tamper-proof screw 21. On the face of the lid are mounted a reset button 18, a light pipe 17 for displaying diagnostic signals and a potentiometer 16 that requires a Phillips head wrench or the like for adjustment. Pull tab 22 extends out from the battery pack through the crack between the battery pack and the case.

Figure 2:
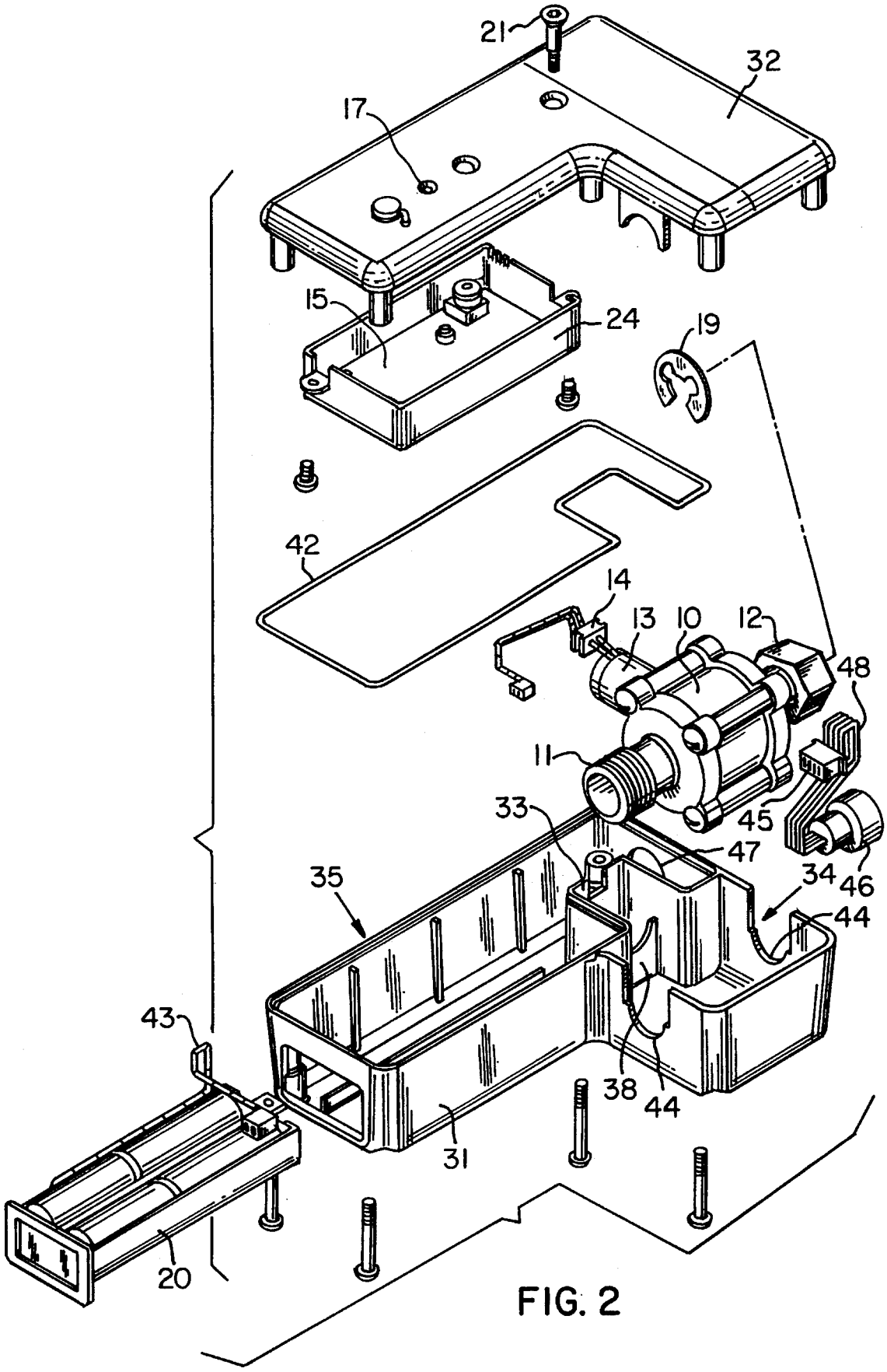
FIG. 2 is an exploded view in perspective of a control unit according to this invention.
Figure 3:
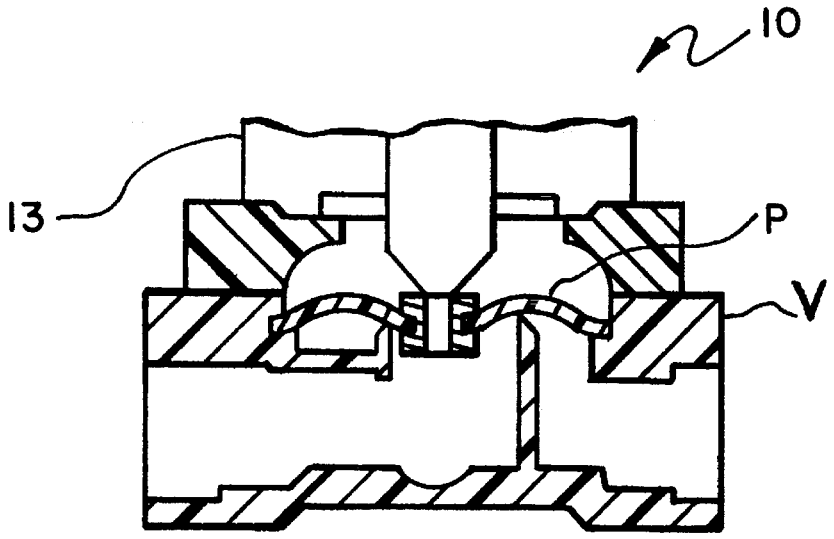
FIG. 3 is a side elevational view, partially in section, of a portion of a diaphragm-type valve with a solenoid-controlled pilot chamber.
Figure 4:
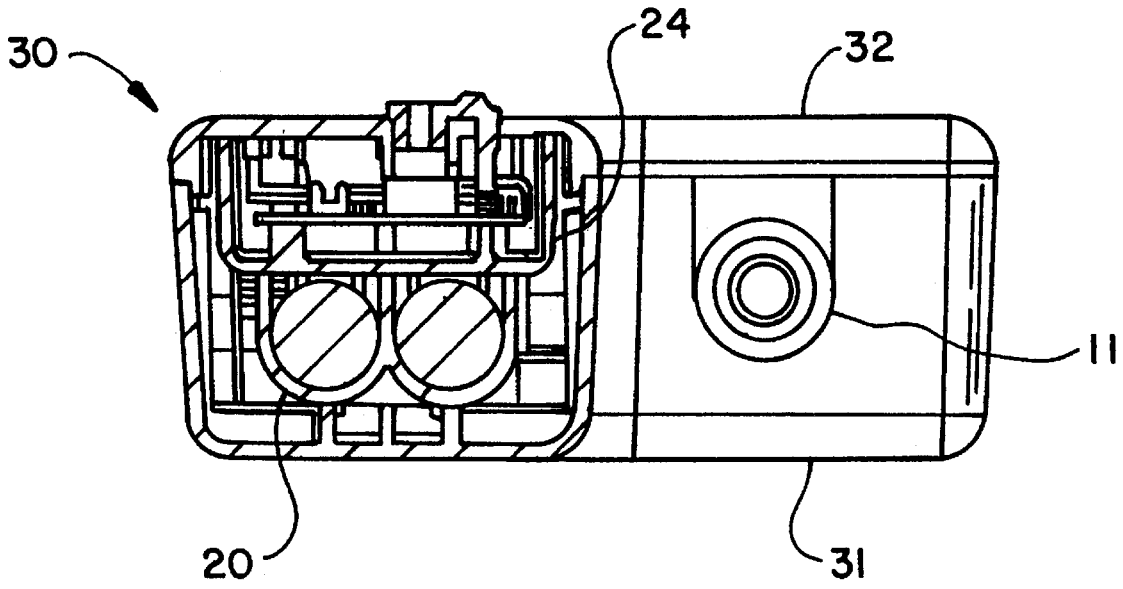
FIG. 4 is a sectional, elevational view along lines IV—IV of the control unit shown in FIG. 1.

Referring now to FIGS. 2 and 4, the control valve assembly 10 has a threaded inlet conduit 11 and an outlet conduit 12 with a nut captured thereon. The solenoid-activated valve "V" is a diaphragm-type valve with a solenoid-controlled pilot chamber "P" as shown in FIG. 3. The solenoid-activated valve is comprised of glass reinforced polyphenylene oxide polymers. Extending to one side of the valve assembly is the solenoid 13 which has two permanently affixed (as by soldering) lead wires extending from the solenoid and passing through grommet 14. The function of the grommet will be explained hereafter.

The box portion 31 of the case is divided into two compartments by a dividing wall 33. In the control valve compartment 34, a cradle is provided by an interior wall 38 and openings 44 in the walls of the case 30 for receiving and supporting the control valve assembly. The inlet and outlet conduits rest in openings 44 and the solenoid 13 rests in the opening provided therefor in the inner wall 38.

An electric compartment 35 is arranged in the case adjacent the control valve compartment but, as will be explained, is sealed therefrom when the lid 32 of the case is placed upon the box portion 31. A gasket or seal 42 in the form of a rubber ring is arranged to be captured between the lid and the box portion to provide a liquid-tight seal between the lid and the box portion and also between the control valve compartment 34 and the electric compartment 35. The grommet 14 fits into an opening provided therefor in the dividing wall 33 enabling lead wires from the solenoid to pass through the electric compartment while maintaining the liquid-tight separation between the two compartments.

A printed circuit board 15 is secured to the underside of the lid by a tray 24 that is held in place by two screws. A four-wire cable assembly 48 has a connector 45 on one end for connecting to the printed circuit board and a fitting 46 on the other end that fits into opening 47 in the electrical compartment and seals the compartment. A retainer clip or a C-clip 19 fit in a groove defined in box portion 31 and fits around fitting 46 to secure fitting 46 to the box portion 31.

A battery pack 20 is arranged to hold four batteries and slide into the bottom of the electric compartment. A flexible cable 43 extends from the terminals in the battery pack to a connector on the printed circuit board.

The compartment 35 is sealed from the external environment by grommet 14, a seal 42, an O-ring provided on screw 21, an O-ring provided on fitting 46 that forms a seal between the fitting and an outer surface of the box portion 31 adjacent the hole 47, and a gasket (not shown) positioned on an inner surface of the battery pack front wall which forms a seal with the outer surface of the box portion 31 when the battery pack is secured to case 30 by screw 21.

The battery pack is located on the bottom of the electric compartment because it will drop out of the electric compartment by gravity when the retaining screw 21 is loosened. To change the batteries, the maintenance person must simply unscrew the retaining screw slightly and disengage the catch. The battery pack then slides out of the case due to the weight of the batteries. The drawer stops on an integral stop within the case. This places the batteries in a convenient location for replacement. Holes are provided in the back of the battery pack to easily remove the batteries therefrom. One simply pokes an object, like a vandal-resistant wrench used to loosen the catch on the pack, through the hole from the back of the pack to push the batteries out of the pack.

According to a preferred embodiment, the light pipe 17 (a small piece of clear acrylic) is solvent welded to the plastic lid. This light pipe provides a guiding pathway for the red light waves from the electronics board to be transmitted from the sealed electric compartment to the outside. A top (outside) of the light pipe protrudes slightly from the lid. The dome refracts the light in the hemisphere from the external surface of the lid. This allows maintenance personnel to view the light from many angles.

According to a preferred embodiment, the plastic pull tab 22 is installed at the assembly plant into the battery pack between one of the battery terminals and the battery contact. All four batteries are then installed in series into the battery pack. The pull tab protrudes from the battery drawer and allows the installer to simply pull and remove the tab to connect all four batteries. This shortens the installation time.

According to an alternate embodiment, the battery drawer can be hard wired to the main electrical supply through a regulated power converter which converts 120 AC voltage to the required DC voltage. This installation is slightly more time consuming than the battery pack embodiment but prevents the need to change batteries every three years. The control assembly described herein is particularly useful with a faucet assembly described in a co-pending application entitled "Spout Assembly For Automatic Faucets" filed on the same day and assigned to the same assignee and incorporated herein by reference.

Having thus described our invention with the detail and particularity required by the Patent Laws, what is claimed protected by Letters Patent is set forth in the following claims.

We claim:

1. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively;

said case comprised of a unitary box portion and a lid;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

2. A control unit according to claim 1 wherein the case is comprised of high-impact strength plastic.

3. A control unit according to claim 2 wherein the case is an acrylonitrile butadiene styrene/polycarbonate plastic.

4. A control unit according to claim 1 wherein the solenoid-activated valve is comprised of glass reinforced polyphenylene oxide polymers.

5. A control unit according to claim 1 wherein the solenoid-activated valve is a diaphragm-type valve with a solenoid-controlled pilot chamber.

6. A control unit according to claim 1 wherein the inlet to the solenoid-activated valve is a one-half inch NPSM thread for connecting a standard ball riser.

7. A control unit according to claim 1 wherein the case is provided with a space for a pull tab extending into the battery pack to interrupt the battery circuit prior to installation.

8. A control unit according to claim 1 wherein a cradle is formed in the solenoid-activated valve compartment for receiving the solenoid-activated valve with the inlet and outlet conduits thereof extending out of the case through openings provided therefor.

9. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively;

said case comprised of a box portion and a lid, wherein the case is an acrylonitrile butadiene styrene/polycarbonate high-impact strength plastic;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

10. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid, wherein the solenoid-activated valve is comprised of glass reinforced polyphenylene oxide polymers;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively;

said case comprised of a box portion and a lid;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

11. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid, wherein said solenoid-activated valve is a diaphragm-type valve with a solenoid-controlled pilot chamber;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively;

said case comprised of a box portion and a lid;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

12. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid, wherein an inlet to the solenoid-activated valve is a one-half inch NPSM thread for connecting a standard ball riser;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively;

said case comprised of a box portion and a lid;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

13. A tamper-resistant control unit for an automatic faucet having a transmitter and a receiver mounted therein for detecting the presence of objects near the automatic faucet, said control unit comprising:

a solenoid-activated valve assembly having inlet and outlet conduits extending therefrom, said solenoid-activated valve assembly having a solenoid-activated valve and a solenoid;

an electronic circuit mounted on a circuit board for communicating electrically with the transmitter and the receiver and for energizing the solenoid when an object is in the vicinity of the faucet;

a battery pack for supplying direct current to the electronic circuit, the transmitter and the solenoid;

a case having separate compartments therein for receiving the solenoid-activated valve assembly, and the circuit board and battery pack, respectively, wherein said case is provided with a space for a pull tab extending into said battery pack to interrupt a battery circuit prior to installation;

said case comprised of a box portion and a lid;

said box portion having a dividing wall therein to define and separate a solenoid-activated valve compartment from a sealed electric compartment;

means to mount the circuit board within the electric compartment;

means for passing control wires from the solenoid-activated valve compartment to the electric compartment while maintaining the seal therebetween; and sealing means between the lid and the box portion for sealing the electric compartment, said battery pack arranged to slide into and out of the electric compartment without removal of the lid.

* * * * *